United States Patent [19]

Noomen

[11] 4,244,989

[45] Jan. 13, 1981

[54] METHOD OF CLEANING AND RUST-PROTECTING A METAL SURFACE

[75] Inventor: Arie Noomen, Voorhout, Netherlands

[73] Assignee: Akzo N.V., Arnhem, Netherlands

[21] Appl. No.: 894,414

[22] Filed: Apr. 7, 1978

[30] Foreign Application Priority Data

Apr. 12, 1977 [NL] Netherlands ..... 7703938

[51] Int. Cl.[3] ..... B05D 1/12; B05D 3/12

[52] U.S. Cl. ..... 427/180; 51/295; 427/292; 427/421

[58] Field of Search ..... 427/421, 292, 205, 180; 51/295, 304, 308; 106/14.15, 14.13, 14.37, 14.44; 252/389 R, 392; 428/470, 142, 144

[56] References Cited

U.S. PATENT DOCUMENTS

| | | | |
|---|---|---|---|
| 2,623,835 | 12/1952 | Van Melsen | 106/14.15 X |
| 3,498,768 | 3/1970 | Geld et al. | 51/295 |
| 3,573,962 | 4/1971 | Blampin | 427/292 X |
| 3,696,048 | 10/1972 | Hausler et al. | 252/392 |
| 3,746,643 | 7/1973 | Rogers | 252/389 R X |

FOREIGN PATENT DOCUMENTS

| | | | |
|---|---|---|---|
| 1377484 | 12/1974 | United Kingdom | 427/205 |
| 1426829 | 3/1976 | United Kingdom | 427/421 |

OTHER PUBLICATIONS

Weast et al., *Handbook of Chemistry and Physics,* 47th edition, Cleveland, Ohio, The Chemical Rubber Co., 1966, p. B-163.

*Primary Examiner*—Evan K. Lawrence

*Attorney, Agent, or Firm*—Stevens, Davis, Miller & Mosher

[57] ABSTRACT

An abrasive particle and method are provided for cleaning and rust-proofing steel prior to painting by subjecting the steel to abrasion with abrasive particles coated with a binder such as a synthetic resin which is compatible with the paint to be applied, and a corrosion resistant salt which has a solubility of not more than 20 grams per liter in water at 20° C. The corrosion resistant composition is deposited on the steel surface as it is abraded.

13 Claims, No Drawings

METHOD OF CLEANING AND RUST-PROTECTING A METAL SURFACE

BACKGROUND OF THE INVENTION

This invention relates to a method of cleaning and protecting a metal surface from rust and simultaneously applying to it a corrosion-resisting composition by subjecting the surface to an abrasive treatment with an abrasive the particles of which are coated with a binder and a corrosion-resisting agent.

A method of the type described above is known from the British Patent Specification No. 1,377,484, in which it is proposed to coat abrasive particles with a binder and a protective metal such as zinc, aluminium, cadmium or lead as a corrosion-resisting agent. Zinc in particular is used as the protective metal.

In the shipbuilding industry and in the manufacture of steel structures, especially where the steel is subjected to a rust-proofing treatment prior to being subjected to further operations, there are disadvantages to the use of zinc as a corrosion-resistant metal. For example, the fumes developed during autogenous or electric cutting and/or welding of steel protected with zinc are injurious to health. The welder, for instance, is then obliged to wear a helmet through which purified air is supplied, which form of protection is, however, a nuisance. Moreover, the workshops must be intensively ventilated. Besides, cutting steel provided with a zinc coat is slower than that of cutting untreated steel or of steel coated with a zinc-free primer.

Although the use in the above-proposed method of, for instance, zinc as a protective metal leads to effective protection against corrosion of the metal surface activated by the abrasive treatment, it has been found that during storage in the open air the metal surface will after some time show a white deposit as a result of the formation of zinc oxidation products such as zinc oxide, zinc hydroxide, and zinc carbonates (so-called "white rust"). When subsequently the metal surface is to be painted, first this white deposit must be removed entirely, which calls for an additional, labor intensive and accurate treating step. In practice it is found that the removal of the deposit is either incomplete or leads to damage of the thin protective metal layer. If the white deposit is not or is only partly removed, the adhesion of the paint system will deteriorate and blisters will be formed, particularly when the paint system is exposed to an aqueous medium such as water of condensation and aqueous solutions of chemicals. Another disadvantage of the known method of coating a metal surface with a zinc coating having a high zinc powder content is that the generally relatively low mechanical strength of the zinc layer will lead to the subsequently applied paint also being mechanically weak, so that it will be damaged easily, for instance, by falling tools, as a result of which there may be additional disengagement of the paint coating.

SUMMARY OF THE INVENTION

An object of the present invention is to provide a method which obviates such drawbacks of the known methods such as the formation of "white rust" and weakening of the paint system as a result of a zinc-rich undersurface while at the same time maintaining the formation on the metal surface of a corrosion-resistant coat during the abrasive treatment.

The foregoing object and others are accomplished in accordance with the invention by providing an abrasive particle and a process for abrading an iron containing surface to be painted with abrasive particles coated with a binder and a corrosion-resisting agent which is a corrosion-resisting salt having a solubility of not more than 20 grams per liter in water at 20° C. The corrosion-resisting agent is bonded to the abrasive-particles with a binder which is compatible with the paint to be applied to the surface. The corrosion resisting compound is deposited on the surface as it is abraded. The corrosion-resisting salt which may be metallic or non-metallic and which is not or is only poorly soluble in water effectively prevents osmotic action following application of the paint system, as a result of which there will be no formation of blisters or other disengaging phenomena of the coating of paint. Moreover, when for instance a metal object is stored in the open the layer of the corrosion-resisting salt is prevented from being removed by rain or water of condensation before the actual paint system is applied to it.

DESCRIPTION OF THE PREFERRED EMBODIMENTS

For examples of suitable, corrosion resisting salts may be mentioned the salts of carboxylic acids containing nitro groups, and preferably the salts of aromatic nitrocarboxylic acids containing 7 to 14 carbon atoms, such as nitrobenzoic acid, nitrophthalic acid, nitroisophthalic acid, nitroterephthalic acid, 3-nitro-2-methylterephthalic acid and nitronaphthalene discarboxylic acid. The heavy metal salts, such as the lead and/or the zinc salts of carboxylic acids are preferred. More particularly, use is made of the zinc salt and the lead-zinc salt of 5-nitroisophthalic acid. As examples of other suitable salts may be mentioned film-forming film-forming, alkaline complex compounds of an alkaline earth metal salt of an organic sulphonic acid and an alkaline earth metal carbonate. Calcium is the preferred alkaline earth metal. A mixture of calcium carbonate and the calcium salt of an alkylphenyl sulphonic acid whose alkyl group contains 22 carbon atoms is most preferred.

The binders with which the abrasive particles are coated may be of a widely different nature. A binder compatible with the paint system to be applied later on is preferred. As examples of suitable binders may be mentioned epoxy resins, polyamide resins, and coumarone indene resins. These binders are compatible with a paint system based on epoxy resin. If the use of a paint system based on, for instance, an unsaturated polyester resin or acrylate resin is desired, then use may be made of a copolymer of styrene and an acrylate monomer such as methylmethacrylate and/or butyl acrylate as binder. Optionally, mixtures of binders may be employed.

As examples of suitable abrasives may be mentioned inorganic materials such as glass beads, copper slag, aluminium oxide granules such as corundum and sand. For the abrasive treatment the abrasive particles are given a high kinetic energy in the same way as is practiced in sand blasting, by incorporation into a gas stream, a vapor stream or a liquid stream or mechanically, as by centrifuged blasting. According to the invention the abrasive treatment of the metal surface is preferably carried out out-of-doors, for instance, in the open air or under cover.

Besides the binder and the corrosion-resisting salt the coating layer of abrasive particles may contain other compounds, for instance, fillers which increase the length of the path of penetration of moisture to the metal surface, such as micro talc, micro mica and mica iron, and rust converting agents. Optionally, also corrosion-resisting metallic powders, such as zinc powder, may be present. In this connection it has surprisingly been found according to the invention that in the presence of zinc the non-metallic, corrosion-resisting salt prevents the formation of "white rust" and forms a mechanically strong substrate.

To the primer applied according to the method of invention there is generally applied a paint system which is preferably pore-free in order to guarantee satisfactory resistence to corrosion. As examples of suitable paint systems are mentioned those that are based on epoxy resins, polyurethane binders, unsaturated polyester resins, acrylate resins, vinyl resins and chlorinated rubbers. If no high demands are made on the chemical resistance of the paint system, use may be made of alkyd resins. To obtain satisfactory protection the coating thickness employed may generally be in the range of 100 to 750 μm. The top coat may be applied in any convenient manner, for instance by brush, roller or spraying, and, if desired, in several steps.

The invention is further described in but not limited by the following examples.

EXAMPLES I–VII

An abrasive in the form of corundum contained in a rotating drum is coated with a corrosion-resisting composition in a manner indicated hereinafter. The corundum and the coating composition are mixed until the composition is homogeneously distributed over the surface of the abrasive particles. The epoxy resin is a diglycidyl ether of Bisphenol A and is commercially available under the trade name "Epikote 828" and has an equivalent weight of 180–210.

The zinc powder is commercially available under the trade name Zincomox AAA and has a minimum zinc content of 98% by weight and a particle size of 2–4 μm.

The compound referred to as calcium sulphonate is a mixture of calcium carbonate and the calcium salt of an alkylphenyl sulphonic acid whose alkyl group contains 22 carbon atoms. The amounts given are in parts by weight. Example I is a comparative example.

EXAMPLE:

| | | |
|---|---|---|
| I | Corundum | 1000 |
| | Epoxy resin | 4 |
| | Zinc powder | 200 |
| II | Corundum | 1000 |
| | Epoxy resin | 4 |
| | Zinc salt of 5-nitroisophthalic acid | 50 |
| III | Corundum | 1000 |
| | Epoxy resin | 4 |
| | Lead-zinc salt of 5-nitroisophthalic acid | 80 |
| IV | Corundum | 1000 |
| | Epoxy resin | 0.4 |
| | Calcium sulphonate | 3.6 |
| | Zinc salt of 5-nitroisophthalic acid | 50 |
| V | Corundum | 1000 |
| | Epoxy resin | 0.4 |
| | Calcium sulphonate | 3.6 |
| | Lead zinc salt of 5-nitroisophthalic acid | 60 |
| VI | Corundum | 1000 |
| | Epoxy resin | 4 |
| | Zinc powder | 150 |
| | Zinc salt of 5-nitroisophthalic acid | 50 |

-continued

| | | |
|---|---|---|
| VII | Corundum | 1000 |
| | Epoxy resin | 4 |
| | Zinc powder | 150 |
| | Lead-zinc salt of 5-nitroisophthalic acid | 50 |

Subsequently, corroded steel plates (steel 37) are abraded with corundum particles coated with the aforementioned compositions until a clean, uniformly coated steel surface is obtained. With the test panels thus obtained the following experiments are carried out.

A. The panels are exposed to open air conditions for a period of four weeks. The panels are evaluated in accordance with ASTM Standard Method D 610. The time taken for the panels to reach rust grade 3 of the rust grade scale is measured. The panels are also examined for the time it takes to form "white rust" thereon, if any. For comparison a steel panel abraded with non-coated corundum is evaluated (control). The values obtained are listed in Table 1.

TABLE 1

| Abrasive | Time to value 3 (ASTM D 610) in days | Formation of white rust after some time (in days) |
|---|---|---|
| Control | 1 | — |
| I (comparison) | 28 | 2 |
| II | 14 | none |
| III | 28 | none |
| IV | 14 | none |
| V | 28 | none |
| VI | 28 | none |
| VII | 28 | none |

B. After the panels have been abraded they are coated with a paint having a high filler content based on epoxy-polyamide to a layer thickness of about 200 μm (dry). After a week's curing at room temperature part of the panels are provided with a scratch and subjected to a salt spray test in accordance with ASTM B117-61. The time to form a 2 mm blister from the scratch is measured. Moreover, on another part of the panels the adhesion of the paint to the substrate is determined (pulling speed: 2 mm/min).

TABLE 2

| Example | Time to form 2 mm blister (in hours) | Adhesive strength (in kg/cm$^2$) |
|---|---|---|
| I (comparison) | 168 | 80 |
| II | 960 | 110 |
| III | 960 | 120 |
| IV | 960 | 110 |
| V | 960 | 110 |

C. After a week's exposure to outdoor conditions the panels are treated with a paint system consisting of two coats of epoxy primer (based on epoxy amine) each having a thickness of 35 μm (dry) and two top coats of polyurethane paint (based on acrylate polyol and the biuret of hexamethylene diisocyanate) each having a thickness of 40 μm (dry). After a week's curing at room temperature part of the panels are provided with a scratch in accordance with ASTM B 117-61 and subjected to a salt spray test. The time to form a 2 mm blister from a scratch is determined. Moreover, on another part of the panels the adhesion of the paint to the substrate is measured (pulling speed: 2mm/min).

TABLE 3

| Abrasive | Time to form 2 mm blister (in hours) | Adhesive strength (in kg/cm$^2$) |
|---|---|---|
| I (comparison) | 72 | 120 |
| II | 96 | — |
| III | 120 | — |
| IV | 96 | — |
| V | 120 | — |
| VI | 288 | 210 |
| VII | 480 | 210 |

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is :

1. A method of cleaning a corrodible metal surface and depositing a layer of corrosion resistant salt thereon prior to painting which comprises abrading the surface with abrasive particles having a coating of a corrosion-resistant salt bonded thereto with a binder which is compatible with the paint to be applied, said salt having a solubility in water at 20° C. of not more than 20 grams per liter.

2. The method of claim 1 wherein the corrosion-resisting salt is a salt of carboxylic acid containing a nitro group.

3. The method of claim 2 wherein the carboxylic acid is a carboxylic acid containing 7 to 14 atoms.

4. The method of claim 2 wherein the corrosion resisting salt is a salt of an aromatic carboxylic acid containing a nitro group.

5. The method of claim 4 wherein the corrosion-resisting salt is a salt of 5-nitroisophthalic acid.

6. The method of claim 5 wherein the corrosion resisting salt is a zinc salt or a lead-zinc salt of a carboxylic acid containing a nitro group.

7. The method of claim 1 wherein the corrosion-resisting salt is a film-forming, alkaline complex compound of an alkaline earth metal salt of an organic sulphonic acid and a alkaline earth metal carbonate.

8. The method of claim 7 wherein the alkaline earth metal salt is a calcium salt.

9. The method of claim 8 wherein the corrosion-resisting salt is a mixture of calcium carbonate and the calcium salt of an alkylphenyl sulphonic acid whose alkyl group contains 22 carbon atoms.

10. The method of claim 1 wherein the corrosion-resisting salt is a non-metallic corrosion-resisting salt which has a solubility of not more than 20 grams per liter in water at 20° C.

11. The method of claim 1 wherein the coating of the abrasive particles also contains a corrosion-resisting metallic powder.

12. The method of claim 11 wherein the metallic powder is zinc powder.

13. An abrasive particle coated with a binder and a corrosion-resisting salt having a solubility of not more than 20 grams per liter in water at 20° C.

* * * * *